US006682065B2

(12) United States Patent
Léonarde et al.

(10) Patent No.: US 6,682,065 B2
(45) Date of Patent: Jan. 27, 2004

(54) DEVICE FOR FEEDING OBJECTS PIECE BY PIECE

(75) Inventors: Staffan Léonarde, Alingsås (SE); Hans Landström, Alingsås (SE)

(73) Assignee: Meco Pak Aktiebolag, Alingsas (SE)

( * ) Notice: Subject to any disclaimer, the term of this patent is extended or adjusted under 35 U.S.C. 154(b) by 0 days.

(21) Appl. No.: 10/203,462

(22) PCT Filed: Jan. 18, 2001

(86) PCT No.: PCT/SE01/00082

§ 371 (c)(1),
(2), (4) Date: Aug. 8, 2002

(87) PCT Pub. No.: WO01/58761

PCT Pub. Date: Aug. 16, 2001

(65) Prior Publication Data

US 2003/0011124 A1 Jan. 16, 2003

(30) Foreign Application Priority Data

Feb. 8, 2000 (SE) ..... 0000383

(51) Int. Cl.[7] ..... B65H 3/34
(52) U.S. Cl. ..... 271/104; 271/105; 271/107
(58) Field of Search ..... 271/105, 104, 271/107, 106

(56) References Cited

U.S. PATENT DOCUMENTS

| | | | | |
|---|---|---|---|---|
| 4,397,457 A | | 8/1983 | Hinchcliffe et al. | |
| 4,678,175 A | | 7/1987 | Arldt et al. | |
| 4,854,569 A | * | 8/1989 | Mizuta | 271/98 |
| 4,921,237 A | * | 5/1990 | Nubson et al. | 271/11 |
| 5,547,336 A | * | 8/1996 | Whiteman | 414/798.9 |
| 6,135,437 A | * | 10/2000 | Maass et al. | 271/5 |

FOREIGN PATENT DOCUMENTS

| | | | | |
|---|---|---|---|---|
| EP | 0 016 376 | | 10/1980 | |
| GB | 2 041 886 | | 9/1980 | |
| JP | 01308034 A | * | 12/1989 | H01L/21/50 |
| JP | 03293236 A | * | 12/1991 | B65H/3/08 |
| SE | 381 348 | | 12/1975 | |

* cited by examiner

*Primary Examiner*—Donald P. Walsh
*Assistant Examiner*—Matthew J. Kohner
(74) *Attorney, Agent, or Firm*—Nixon & Vanderhye

(57) ABSTRACT

The invention concerns a device for feeding objects which have the shape of essentially flat but flexible sheets (1) or blanks of sheet material, piece by piece from the top of a magazine (24) consisting of a plurality of such objects which are arranged on top of one another, comprising separation means **(31*a*, 31*b*, 27*a*, 27*b*) for parting the uppermost object from the underlying objects in the magazine, before it is moved from the magazine, and first motion devices (42, 43, 44, 45) for removing the parted uppermost object from the magazine. A characteristic feature is that said separation means comprises members provided to bend the uppermost object (1*a*)** to adopt an upwardly convex shape, while the adjacently underlying object is bent to a less convex shape than the uppermost object, or remains at least essentially flat, before the uppermost object has been removed from the magazine.

7 Claims, 5 Drawing Sheets

DEVICE FOR FEEDING OBJECTS PIECE BY PIECE

TECHNICAL FIELD

The invention relates to a device for feeding objects which have a shape of essentially flat but flexible sheets or blanks of sheet material, piece by piece from the top of a magazine consisting of a plurality of such objects which are arranged on top of one another, comprising separation means for parting the uppermost object from underlying objects in the magazine, before it is moved from the magazine, and first motion devices for removing the parted uppermost object from the magazine.

BACKGROUND OF THE INVENTION

Devices of the above mentioned kind have many industrial applications. One such application is packaging machines, in which sheets or blanks shall be fed from a stack into a machine, where the sheet or blank is folded to form a package and is also possibly filled automatically. In order that such a machine shall operate without interruptions all sub-operations must function from the feeding in of said sheets or blanks to the feeding out of the finished package. An operation which has always been a problem is the feeding of the sheets or blanks from a storage containing the sheets or blanks, because the objects often have a tendency to stick together. The adherence may depend on electrostatic charges but is particularly pronounced in the case of packaging blanks that have punched out holes, flaps, slots, etc., which easily cause the blanks to hitch onto one another. In order to avoid this, devices of the above mentioned kind have been developed, which comprise separation means for parting the uppermost object from the underlying objects in the magazine before the object is moved from the magazine. Such a separation means may comprise rotating, spiked rollers, which work against a pair of opposite edges of the sheet/blank. The rollers may be combined with air nozzles, which blow in air between the sheets to part them. The devices which are commercially available at the present, however, do not solve the problem satisfactorily, at least not when the objects in question have the shape of paperboard blanks having punched out flaps, holes, slots, etc., which make the separation difficult.

It is also crucial that the devices which are employed for feeding sheets or blanks into a packaging machine piece by piece can operate completely continuously. If, for example, the feeding in device needs to be stopped for replenishing the magazine with packaging blanks, the whole process of the integrated packaging machine is interrupted. This is also a problem that has not been solved satisfactorily according to prior art.

BRIEF DISCLOSURE OF THE INVENTION

An aim of the invention is to solve the above mentioned problems. The first of these, namely to provide a device that has well functioning separation means for parting the uppermost object from the underlying objects in a magazine, according to the invention, is solved therein that said separation means comprises members provided to bend the uppermost object to adopt an upwardly convex shape, while the adjacently underlying object is bent to a less convex shape than the uppermost object, or it remains at least essentially flat, before the uppermost object has been removed from the magazine.

The second problem, namely to provide a device mentioned in the preamble, which can operate continuously is solved according to the invention therein that said magazine, in which the uppermost object is parted from the underlying objects of the magazine before it is moved from the magazine, is a buffer store; that the device also contains a storage comprising a stack which may consist of an essentially larger number of objects than the buffer store; and that second motion means are provided to replenish the buffer store from the storage. Preferably said storage is provided under the buffer store, wherein said second motion means are provided to move said stack upwards in the storage in order to replenish the buffer store as the buffer store is successively emptied by feeding out objects from the buffer store piece by piece, and wherein locking means are provided to keep the buffer store in place in feeding out position, while the storage is being replenished by a new stack of objects.

Further characteristic features and aspects as well as advantages of the invention will be apparent from the appending patent claims and from the following description of a preferred embodiment.

It shall in this connection also be mentioned that said sheets or blanks may consist of widely different materials, such as for example paper, paperboard, plastic, metal foil, etc. as well as of combinations of two or more of said materials. The terms sheets or blanks of sheet material therefore are not restricted to any specific types of materials.

BRIEF DESCRIPTION OF DRAWINGS

In the following description, reference will be made to the accompanying drawings, in which.

DETAILED DESCRIPTION OF AN EMBODIMENT

Figure 1:
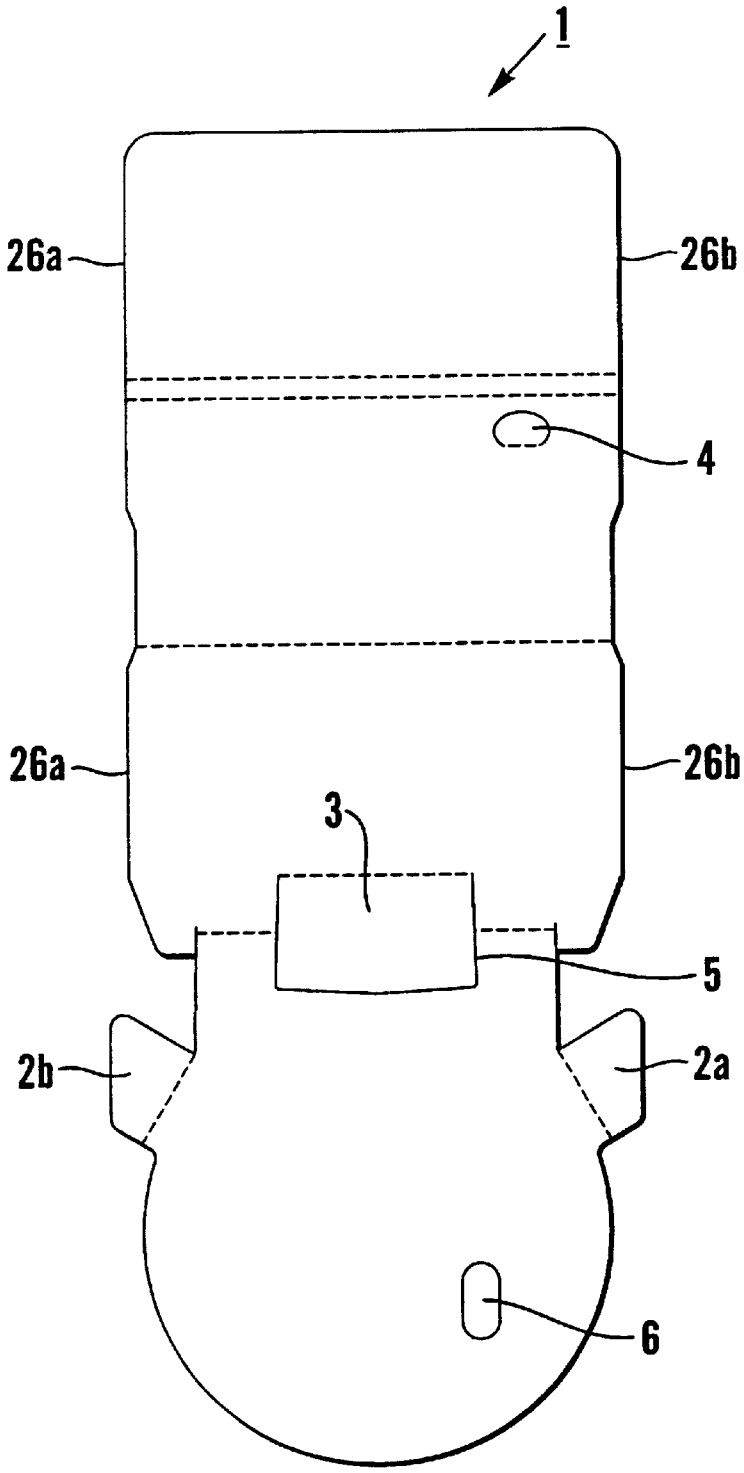
FIG. 1 shows a blank of paperboard intended to form a slide, which shall form enclosure for one or a pair of CD discs.

FIG. 1 shows a blank 1 intended to be folded in the shown folding lines in a packaging machine to form a slide for a CD disc which shall be packaged. The blank 1 is flat and consists according to the embodiment of paperboard which is about 0.5 mm thick. It has a number of flaps or tongues 2*a*, 2*b*, 3, 4, slots 5, and holes 6, which can make it difficult to part the blanks 1 from one another, when the blanks are arranged in a stack, from which the blanks 1 shall be lifted up piece by piece and moved sideways into a packaging machine.

Figure 2:
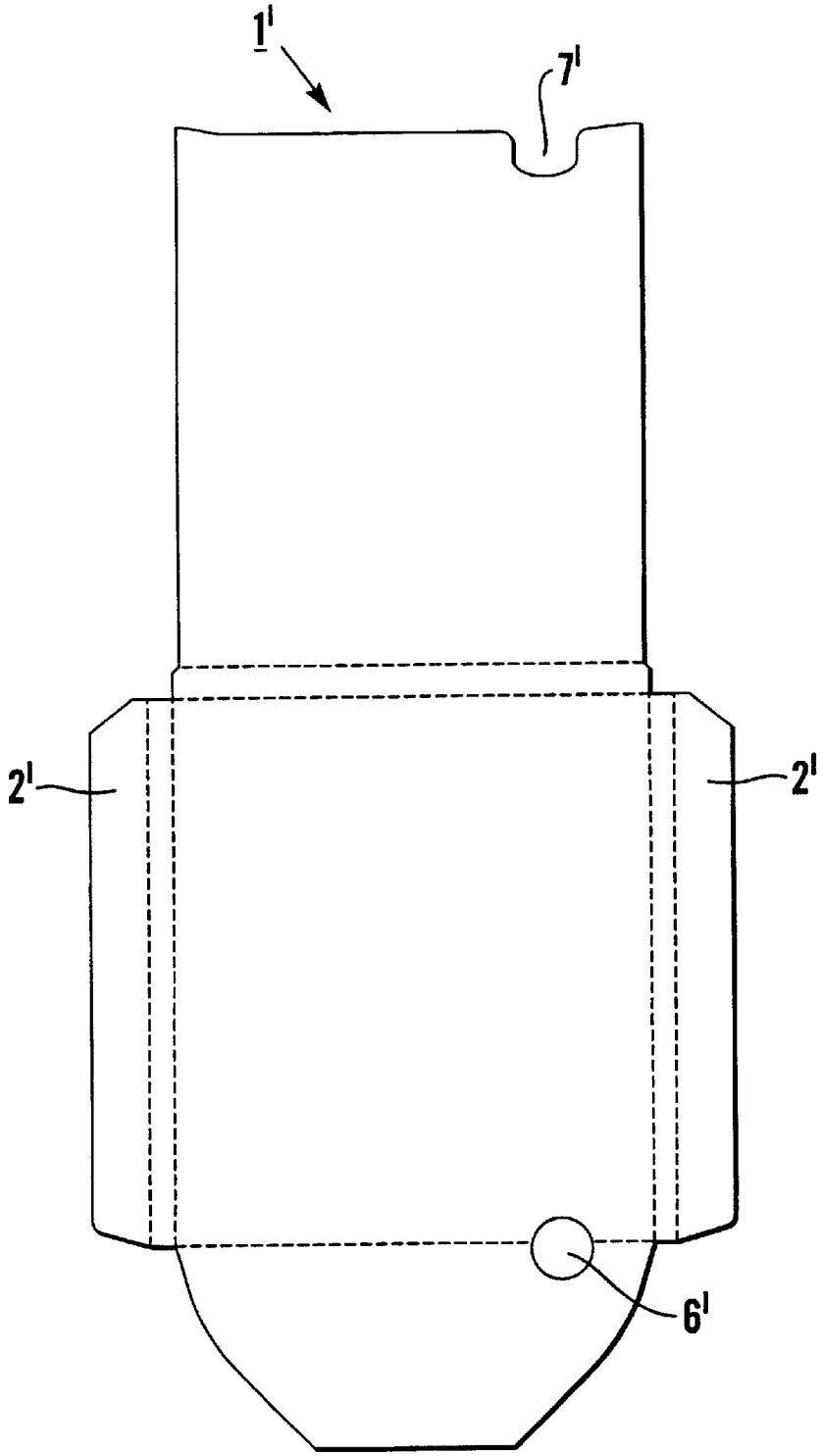
FIG. 2 shows another blank of paperboard intended to form a sleeve for a slide containing one or a couple of CD discs.

FIG. 2 shows a blank 1', which by folding in the folding lines is intended to form a sleeve, which shall receive a slide, comprising one or a couple of CD discs. Also the blank 1' has a pair of flaps 2', a hole 6' and a recess 7'.

Figure 3:
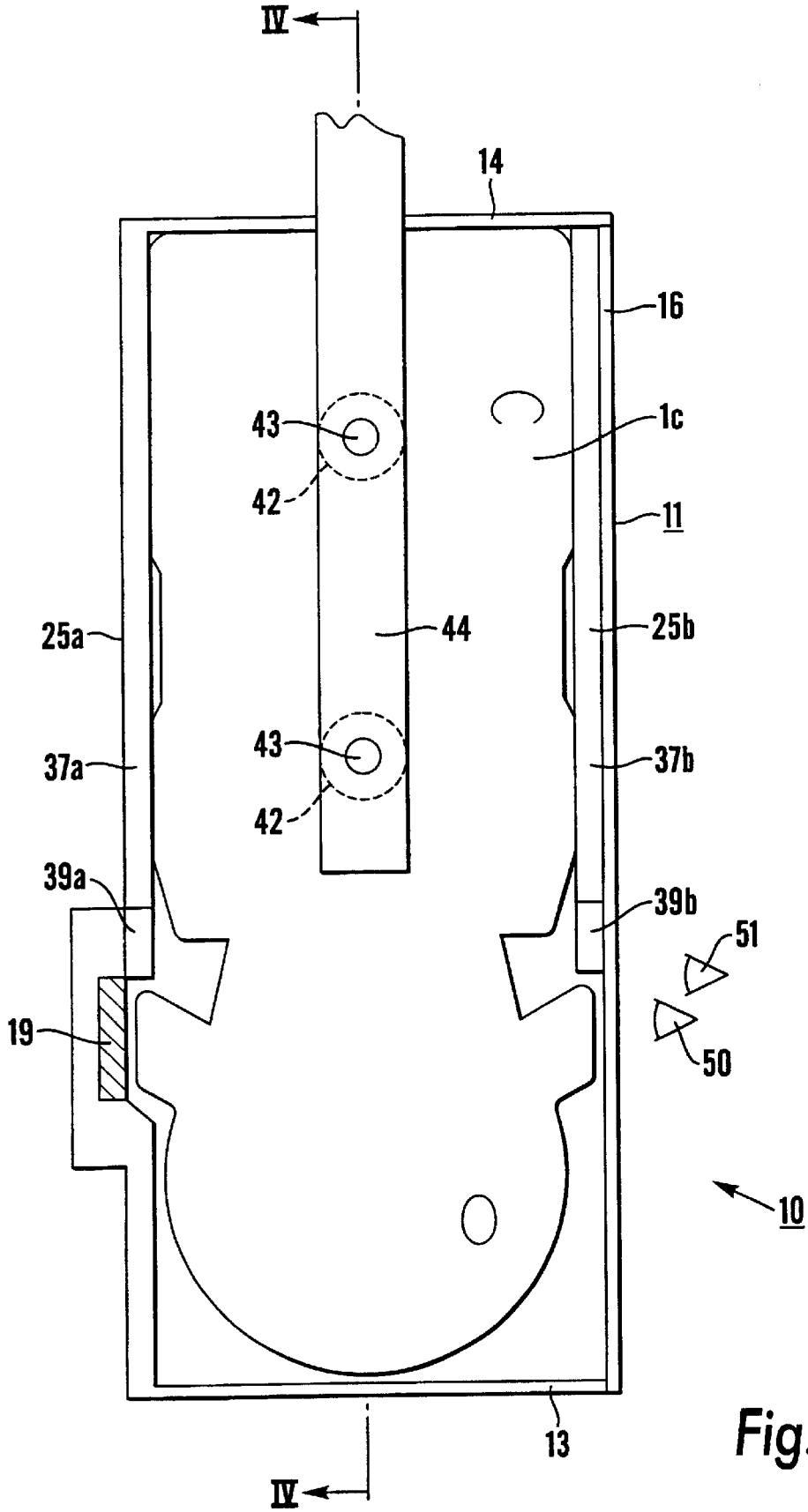
FIG. 3 is a top view of a portion of a device according to an embodiment of the invention.
Figure 4:
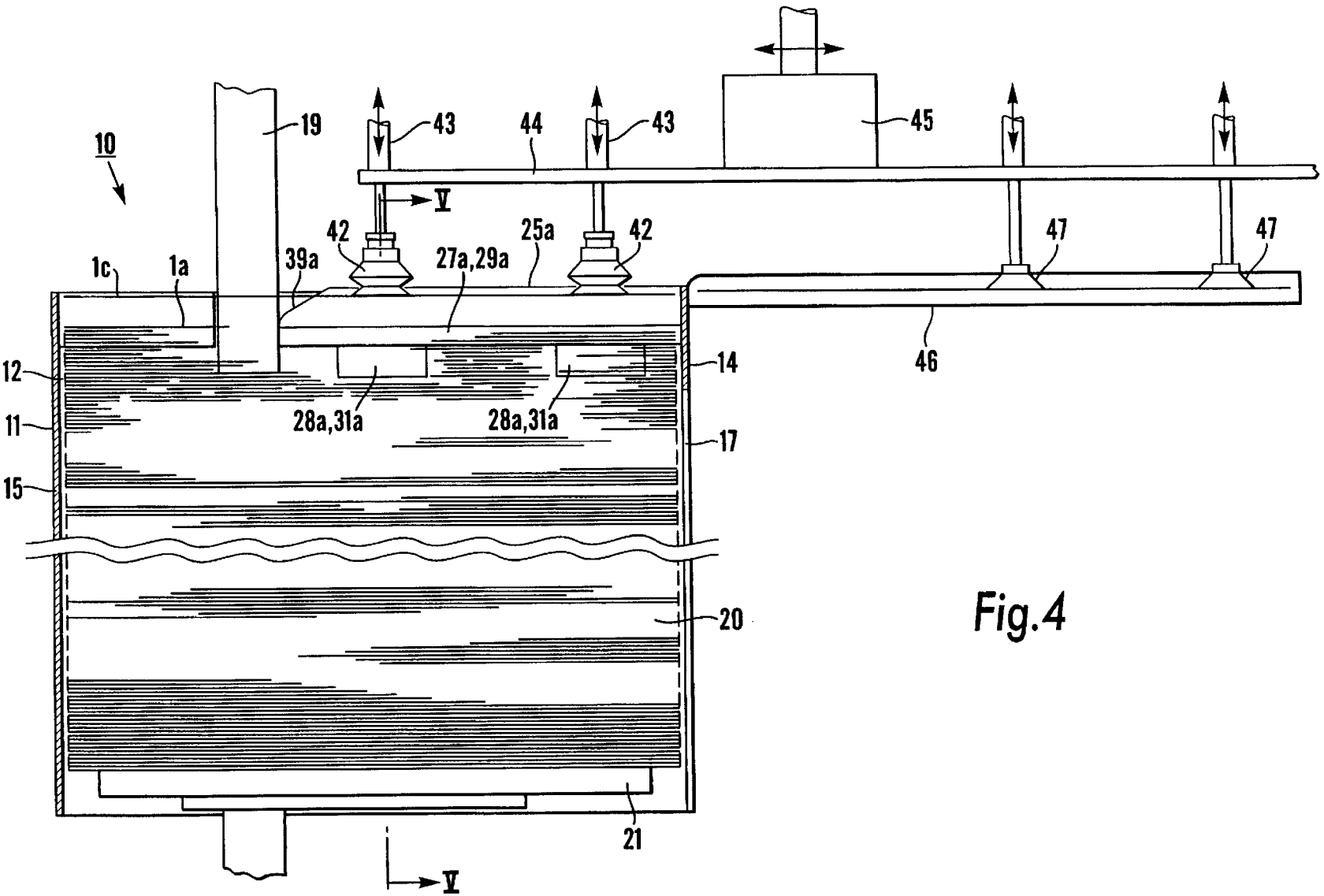
FIG. 4 shows the device along the line IV—IV in FIG. 3.
Figure 5:
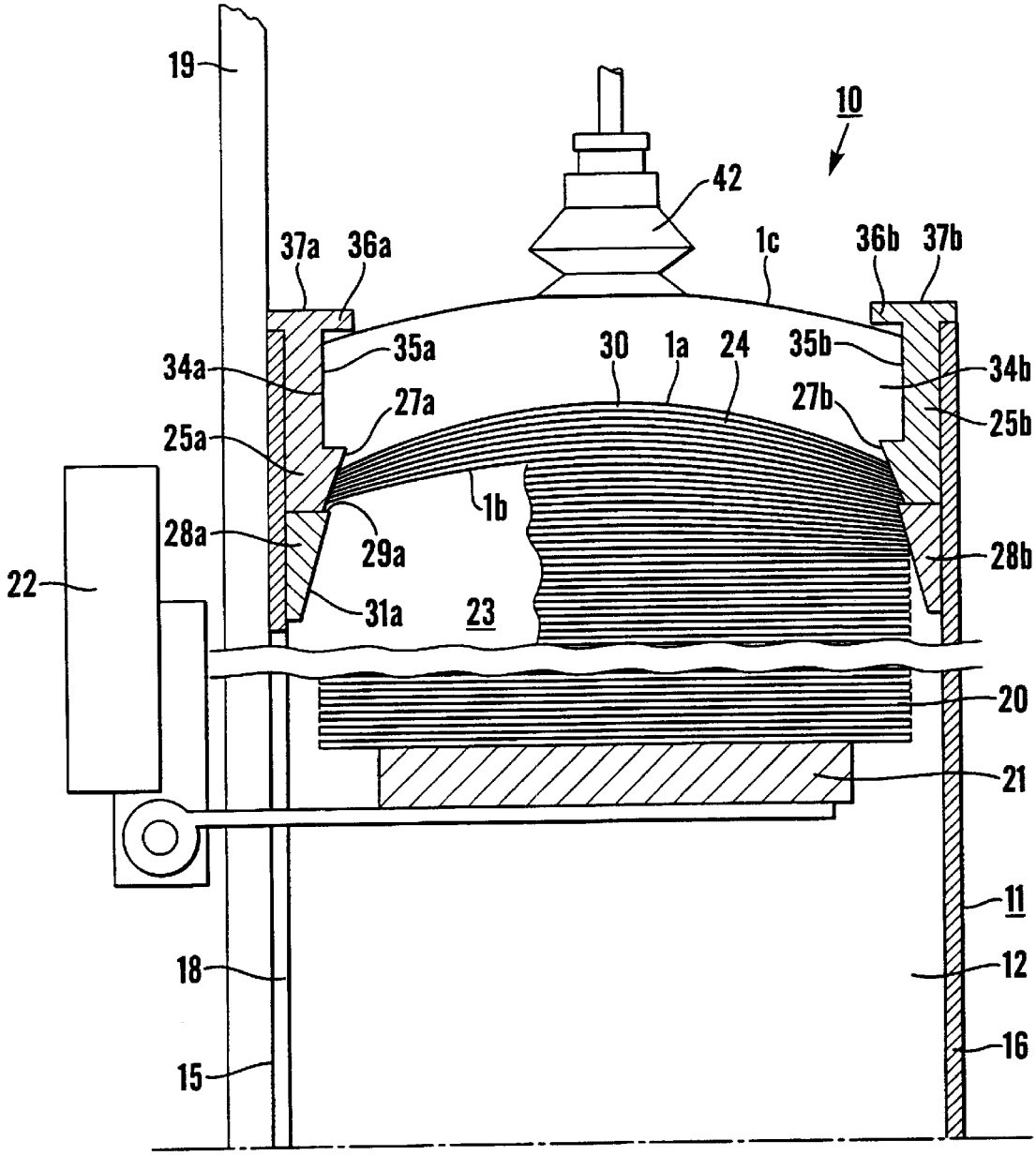
FIG. 5 shows the upper part of the device in a view along the line V—V in FIG. 4; including a partly emptied stack of blanks in an uplifted position.

In FIGS. 3–5, which shows the device, generally designated 10, for feeding blanks 1 piece by piece, a storage for the blanks is designated 11. The inner space 12 of the storage 11 is limited by four vertical walls; a front wall 13, a rear wall 14 with an opening 17, a left hand side wall 15 with an opening 18, and a right hand side wall 16. The storage 11 is mounted on a stand, of which it is only a vertical bar member 19 shown. In the space 12 in the storage 11 there is a stack 20 of blanks 1; the number may amount e.g. to 1000 pieces. In FIG. 4 the stack 20, the storage 11 is shown when it is essentially filled with blanks 1, while FIG. 5 shows an almost emptied stack 20. The stack 20 rests on a bottom plate 21, which can be lifted stepwise and be lowered by means of an elevator 22, which is only schematically shown in FIG. 5. The elevator 22, which in the patent claims is referred to as second motion means, may comprise an electric motor of the type that can work stepwise.

Over the stack 20 there is a buffer store 24 of blanks 1. The number of blanks 1 in the buffer store 24 depends of the thickness of the blanks, which may vary depending of the material in the blanks, but may typically amount to about 10–15 pieces. That number is sufficient so that the device without interruptions shall be able to feed out blanks 1 from the buffer store 24, while the storage 11 is being replenished by a new stack 20 of blanks, when the storage has been emptied.

In the buffer store 24 the approximately 10–15 blanks 1 lie clamped between two longitudinal rails 25*a* and 25*b* on each side of the blank 1. More particularly, the edge portions of the blank which in FIG. 1 have been designated 26*a* and 26*b* abut the lower surfaces 27*a* and 27*b*, respectively, of the rails 25*a* and 25*b*, which face one another. The surfaces 27*a* and 27*b* slope inwards-upwards and are slightly concave.

Under the buffer store 24 there is an entrance portion 23. In the entrance portion 23 there is a pair of projections 28*a* and 28*b* under the rails 25*a* and 25*b*, one under each rail. The projections 28*a* and 28*b* in their uppermost parts project a distance beyond the lower edge of the inwards-upwards inclined surfaces 27*a* and 27*b* of the two rails 25*a* and 25*b*, so that two shelves 29*a* and 29*b* are formed, one under each rail 25*a* and 25*b*. The projections 28*a* and 28*b* have a length in the longitudinal direction of the blank 1 which is somewhat shorter then the edge portions 26*a*, 26*b* of the blank and are placed in such positions under the rails 25*a* and 25*b*, respectively, that the undermost blank 1*b* in the buffer store 24 will rest with its edge portions 26*a* and 26*b* on the shelves 29*a* and 29*b*, respectively, which shelves have a very short extension, about 1 mm, in the cross direction. This, however, is sufficient to prevent the undermost blank 1*b* to move downwards once it has been pressed up and has snapped-in beyond the projections 28*a*, 28*b*. Therein the buffer store 24 is kept in place through cooperation between the shelves 29*a*, 29*b* and the inclined surfaces 27*a*, 27*b*, which makes it possible to lower the bottom plate 21 by means of the elevator 22 and to supply a new stack 20 of blanks 1 to the storage 11, while at the same time blanks continue to be fed out from the buffer store 24.

In the buffer store 24 the blanks, with the undermost blank 1 resting on the shelves 29*a*, 29*b*, are clamped between the inwards-upwards inclined surfaces 27*a* and 27*b*. The distance between the surfaces 27*a* and 27*b* is shorter than the distance between the edges 26*a* and 26*b* of the flat blank 1, FIG. 1, which causes the blanks to adopt a convex shape like a bow, the convexity of which increases from below and upwards. The thus established constriction of the passageway of the blanks forces the blanks to bend upwards as they move upwards between the rails 25*a* and 25*b*, at the same time as it also forces the blanks to part, i.e. so that thin air gaps 30 are formed between adjacent blanks; the thickness of the gaps increasing from below and upwards. The thickest gap 30 thus exists between the uppermost blank 1*a* and its most adjacently underlying blank.

The sides 31*a* and 31*b* of the projections 28*a* and 28*b*, respectively, which face one another in the entrance portion 23 are also inclined inwards and upwards at about the same angle of inclination as the surfaces 27*a* and 27*b* of the rails 25*a* and 25*b*, respectively. The bottom plate 21 is narrower than the blanks in the stack, which make it possible for the upper blanks in the stack to be caused to bend as they are pressed against the projections 31*a* and 31*b*. As the stack 20 is being pressed upwards between the projections 28*a* and 28*b*, the edges 26*a* and 26*b* of the upper blanks 1 in the stack 20 thus will slide against the surfaces 31*a* and 31*b*, causing the blanks to be arced more and more during the upwards directed movement between the projections 28*a* and 28*b* before the uppermost blanks of the stack are successively pressed up and snapped-in beyond the upper edge of the surfaces 31*a* and 31*b*, which at the same time define the outer edges of the shelves 29*a* and 29*b*, to be introduced into the buffer store 24.

The rails 25*a* and 25*b* extend from the rear wall 14 of the storage 11 almost all the way to the two ears 2*a* and 2*b* of the blanks 1 in the buffer store 24. The distance between the outer edges 8*a* and 8*b* of the ears 2*a* and 2*b* are slightly larger than the distance between the edges 26*a* and 26*b*.

In the upper part of the two rails 25*a* and 25*b* there is a longitudinal recess 34*a* and 34*b*, respectively. The vertical surfaces 34*a* and 34*b* of the groove, which face one another, have been designated 35*a* and 35*b*, respectively. The distance between the surfaces 35*a* and 35*b* are approximately equal with the distance between the lower edge of the inclined surfaces 27*a* and 27*b*, i.e. the distance between the inner edges of the shelves 29*a* and 29*b*. This implies that a blank 1*c*, which is lifted from the buffer store 24 up to the region of the longitudinal recesses 34*a* and 35*b*, will adopt approximately the same convex shape as the lower blank 1*b* in the buffer store 24, still being clamped between the rails but with the edges 26*a* and 26*b* abutting the surfaces 35*a* and 35*b*. The recesses 34*a* and 34*b* are at the top bordered by an inwardly directed flange 36*a* and 36*b*, respectively.

The upper surfaces of the rails 25*a* and 25*b* are designated 37*a* and 37*b*, respectively. In their front ends, the rails 25*a* and 25*b* have a bevel 39*a*, 39*b*.

In order to lift the uppermost blank 1*a* in the buffer store 24 to the level which is represented by the blank 1*c* in FIG. 5, there are provided a couple of first suction cups 42 with accompanying suction and lifting members, schematically shown by 43, which may be of a commercially available type. These members are referred to as first motion devices in the appending patent claims. Suitably the suction cups 42 are resilient and of so called bellows type, which can adhere by suction to and also lift curved objects. The suction cups 42 are oriented between the projections 28*a* and 28*b* and are mounted on a common carrier 44, which can be moved forwards and backwards by means of a schematically shown, third motion device 45. Behind the storage 11 there is a table 46 for delivery of the blanks piece by piece and for further transportation of the fed out blanks. For this transportation other suction cups 47 are provided, mounted on the common carrier 44 which means that they work concurrently with the first suction cups 42. These other suction cups 47 do not form part of the present invention and will therefore not be described here in any detail.

The device also includes some optical sensors. Thus there is a first sensor 50, which indicates if there are any blanks 1 in the storage 11 immediately under the buffer store 24. A second sensor 51 indicates whether blanks exist at working level in the buffer store 24, i.e. at a working level for said first motion devices, which include the suction cups 42 which can operate within a region that has some extension in a vertical direction because of the resiliency of the suction cups. If that indication is not at hand, the elevator 22 will lift the stack 20 in the storage until indication is given, provided there are blanks in the storage.

The thus described device is intended to operate in the following way.

It is supposed that the sensor 51 transmits a signal that there are blanks 1 at a working level, i.e. that there are blanks in the buffer store 24 and that the sensor 50 transmits a signal that there are blanks 1 also in the storage 11. It is further assumed that a packaging machine, to which the device 10 is connected, is working according to a program for automatic operation. At a pace which is determined by a program applied to the packaging machine, the uppermost blank 1*a* is fetched from the buffer store 24 and is laid on the delivery table 46, at the same time as a previously fed blank which has been laid on the table 46, is fetched by said other suction cups 47 and is moved further towards the not shown packaging machine. The fetching of the uppermost blank 1*a* from the buffer store 46 is performed therein that the two section cups 42 are lowered by the motion devices 43 from an upper starting position and are pressed with some force against the rear portions of the blank 1*a*, which are clamped between the inclined surfaces 27*a* and 27*b* of the rails 25*a* and 25*b*, respectively. Because the suction cups 42 are of the bellows type, the cups fasten very well by the suction in spite of the curved shape of the blank 1*a*. The lower blank 1*b* rests on the shelves 29*a*, 29*b*, which provide a sufficient anchoring of the buffer store 24 and resistance against the pressing force by the suction cups 42 for keeping the whole buffer store 24 in place. In this connection, however, it should be mentioned that the pressing force of by the resilient suction cups 42 is comparatively small.

The uppermost blank 1*a*, which is parted from the nearest underlying blank because of the upwards increasing conicity of the buffer store 24, as has been explained in the foregoing, now is lifted up by the suction cups 42, causing the side edges 26*a*, 26*b* of the blank to snap-in beyond the upper edges of the sloping surfaces 27*a* and 27*b*. The blank 1*a* is then lifted further upwards in the region which is represented by the recesses 34*a*, 34*b* to the position represented by the blank 1*c*, FIG. 5.

The blank 1*c* is now pulled sideways, more specifically to the right with reference to FIG. 4, by means of said third motion device 45 with the edges 26*a*, 26*b* of the blank 1*c* sliding against the surfaces 35*a* and 35*b* of the recesses 34*a*, 34*b* facing one another. The recesses 34*a* and 34*b* in this movement thus work as guides for the blank 1 during its horizontal transportation. The two ears 2*a*, 2*b* of the blank 1, which have a larger extension in the cross direction than the rear part of the blank, will at the rearwardly directed movement slide up on the bevels 39*a*, 39*b*, whereafter the ears slide against the flanges 36*a*, 36*b* and/or against the upper surfaces 37*a*, 37*b* of the rails 25*a* and 25*b*, respectively. Finally the blank 1*c* is delivered on the table 46. The suction cups are caused to release the blank, and are lifted and returned to their starting position.

At the same time as said first and third motion devices feed out blanks piece by piece from the top of the buffer store 24, the buffer store is replenished from beneath by order initiated by the sensor 51, when the sensor indicates that there are no blanks at the working level. The command signal is transmitted to the elevator 22, which lifts the bottom plate 21 and hence the whole stack 20 stepwise upwards. Each step has a length of 2–6 mm, so that about 1–10 blanks are pressed up into the buffer store 24 at each step from the region of the projections 28*a*, 28*b*, where the bending and hence the separation of the blanks 1 is initiated through the pressing of the edge portions 26*a*, 26*b* against the inclined surfaces 31*a* and 31*b*. This is possible because the bottom plate 21 is narrower than the blanks 1.

The feeding is continued in the described way until the storage 11 has been emptied. When the sensor 50 transmits a signal indicating that there are no more blanks in the store 11, the elevator 22 receives a command signal so that it is quickly lowered to a bottom position. The storage 11 is filled with a new supply of blanks 1, about 1000 pieces, through the opening 17 in the rear wall 14 by means of not shown, fourth motion devices from a not shown, larger store. This is also made automatically by means of devices which may be of a type known per se and which therefore are not described herein in any detail. The elevator 22 than is quickly lifted until the sensor 50 again transmits a signal indicating that there now are blanks in the storage 11, wherein the upper blanks of the stack 20 will be brought to contact the inclined surfaces 31*a*, 31*b* of the two projections 28*a* and 28*b*, respectively, whereafter the feeding is made stepwise by command initiated by the sensor 51. While the storage 11 is being replenished, in the mode as has just been described, the feeding of blanks upwards from the buffer store 24 goes on, which means that the feeding need not be discontinued because of replenishment of the storage 11.

For the feeding of the sleeve blanks 1' there is a device used that has in principal the same design as has been described above. The device is modified with reference to the shape and size of the sleeve blanks 1' but in further respects the design and the mode of operation is the same as has been described.

What is claimed is:

1. Device for feeding objects which have a shape of essentially flat but flexible sheets or blanks of sheet material, piece by piece from the top of a magazine, said magazine being a buffer store consisting of a plurality of such objects which are arranged on top of one another, said device comprising:

separation means for parting an uppermost object from underlying objects in said magazine, before said uppermost object is moved from the magazine;

first motion devices for removing the parted uppermost object from said magazine;

said separation means comprising members provided to bend at least said uppermost object to adopt an upwardly convex shape, while an adjacently underlying object is bent to a less convex shape than said uppermost object, or remains at least essentially flat, before said uppermost object has been removed from said magazine, a storage containing a stack consisting of a larger number of objects than said buffer store;

second motion devices for replenishing said buffer store from said storage;

said separation means comprising at least two opposite separating elements, at least one on each side of said buffer store, for pressing against two opposite edge portions of at least said uppermost object in said buffer store, so that said uppermost object is kept tensioned as a bow to form said convex shape;

an entrance portion provided under said buffer store for guiding objects up into said buffer store; and at least a pair of entrance elements provided on each side of said stack in said entrance portion, said entrance element on each side of the stack having upwards-inwards inclined surfaces facing one another, said surfaces urging the uppermost objects of the stack to adopt a bow-shaped, upwardly convex shape, before they are pressed further upwards by said second motion devices in order successively to be included with the buffer store;

the upper edges of said upwards-inwards inclined surfaces of said entrance elements which face one another being separated by a distance which is smaller than the distance between the two opposite separation elements in their lowermost ends.

2. Device according to claim 1, wherein said storage is provided under said buffer store, second motion devices are provided to move said stack upwards in said storage in order to replenish said buffer store as the buffer store successively is emptied by feeding out objects piece by piece from said buffer store, and wherein locking means are provided to keep said buffer store in place in feeding out position, while said storage is being replenished by a new stack of objects.

3. Device according to claim 1, wherein a pair of abutments is provided, against which said opposite edge portions of said undermost object of the buffer store may rest, said abutments acting as said locking means against downward movements of the lower object and of the whole buffer store.

4. Device according to claim 1, wherein said separation means comprises two stationary elements, one on each side of the blanks in the region of said buffer store, which elements have upwards-inwards inclined surfaces facing one another, against which two opposite edges of the blanks in the buffer store are pressed.

5. Device according to claim 3, wherein said abutments consist of shelves in a transition between said entrance elements and said separation elements.

6. Device according to claim 1, wherein above said separation means there are provided guiding tracks extending in the horizontal direction, said first motion devices are provided to lift the objects piece by piece up to the region of said guiding tracks, and third motion devices are provided to move the object in the horizontal direction with the edges of the object contacting the surfaces of the guiding tracks which face one another.

7. Device according to claim 1, wherein said second motion devices comprise an elevator and a carrier for the stack of objects, the movement of the elevator being controlled by sensors, comprising a first sensor provided to detect if objects are present in the storage, and a second sensor provided to detect if objects are present at a working level in the buffer store, said first sensor being provided to initiate a command signal to the elevator to lower the carrier rapidly to replenish the storage by a new stack and thereafter quickly lift the carrier with the stack, and said second sensor being provided to initiate a command signal to the elevator to lift the carrier stepwise and also the stack resting on the carrier, provided the first sensor is detecting that objects exist in the storage, for moving a smaller number of objects from said entrance portion charge-wise and with snap-in action beyond said abutment up into the buffer store until said second sensor emits a signal that objects are again present at said working level in said buffer store.

* * * * *